US007954416B2

(12) United States Patent
Cioffi

(10) Patent No.: US 7,954,416 B2
(45) Date of Patent: Jun. 7, 2011

(54) BULLET-PROOF STRUCTURE

(76) Inventor: Cosimo Cioffi, Cerreto Guidi (IT)

( * ) Notice: Subject to any disclaimer, the term of this patent is extended or adjusted under 35 U.S.C. 154(b) by 374 days.

(21) Appl. No.: 12/067,573

(22) PCT Filed: Sep. 21, 2006

(86) PCT No.: PCT/IB2006/002622

§ 371 (c)(1),
(2), (4) Date: Jul. 23, 2008

(87) PCT Pub. No.: WO2007/042877

PCT Pub. Date: Apr. 19, 2007

(65) Prior Publication Data

US 2008/0314237 A1 Dec. 25, 2008

(30) Foreign Application Priority Data

Oct. 7, 2005 (IT) ..... FI2005A0210

(51) Int. Cl.
*F41H 5/02* (2006.01)

(52) U.S. Cl. ..... 89/36.02; 89/921; 89/922; 89/939; 89/36.05

(58) Field of Classification Search ..... 89/36.02, 89/904–916, 921, 922, 939, 36.05; 2/2.5
See application file for complete search history.

(56) References Cited

U.S. PATENT DOCUMENTS

| | | | | |
|---|---|---|---|---|
| 4,079,464 | A | 3/1978 | Roggin | |
| 4,307,140 | A | 12/1981 | Davis | |
| 4,812,359 | A * | 3/1989 | Hall | 428/332 |
| 4,908,083 | A * | 3/1990 | Hall | 156/99 |
| 4,919,037 | A | 4/1990 | Mitchell | |
| 5,019,443 | A * | 5/1991 | Hall | 428/215 |
| 5,060,314 | A * | 10/1991 | Lewis | 2/2.5 |
| 5,180,880 | A | 1/1993 | Zufle | |
| 5,271,879 | A * | 12/1993 | Saatchi et al. | 264/46.5 |
| 5,326,606 | A * | 7/1994 | Labock | 428/49 |
| 5,349,893 | A * | 9/1994 | Dunn | 89/36.05 |
| H001567 | H * | 8/1996 | Parsons et al. | 89/36.02 |
| 5,591,933 | A * | 1/1997 | Li et al. | 89/36.02 |
| 5,763,813 | A * | 6/1998 | Cohen et al. | 89/36.02 |
| 5,966,747 | A | 10/1999 | Crupi et al. | |
| 6,112,635 | A * | 9/2000 | Cohen | 89/36.02 |
| 6,276,254 | B1 * | 8/2001 | Cordova et al. | 89/36.02 |
| 6,289,781 | B1 * | 9/2001 | Cohen | 89/36.02 |
| 6,568,310 | B2 * | 5/2003 | Morgan | 89/36.02 |
| 6,920,817 | B2 * | 7/2005 | Ravid et al. | 89/36.11 |
| 6,945,155 | B2 * | 9/2005 | Cordova et al. | 89/36.02 |
| 7,549,366 | B2 * | 6/2009 | Park et al. | 89/36.02 |
| 7,562,612 | B2 * | 7/2009 | Lucuta et al. | 89/36.02 |
| 7,584,689 | B2 * | 9/2009 | Jones et al. | 89/36.02 |
| 7,685,921 | B2 * | 3/2010 | Dagher et al. | 89/36.02 |
| 7,762,175 | B1 * | 7/2010 | Bhatnagar et al. | 89/36.02 |
| 2010/0011947 | A1 * | 1/2010 | Yeshurun et al. | 89/36.02 |

FOREIGN PATENT DOCUMENTS

| | | | |
|---|---|---|---|
| GB | 578 640 | A | 7/1946 |
| GB | 2 124 887 | A | 2/1984 |
| WO | WO 2005/022071 | A1 | 3/2005 |

* cited by examiner

*Primary Examiner* — Troy Chambers
*Assistant Examiner* — Samir Abdosh
(74) *Attorney, Agent, or Firm* — Pearne & Gordon LLP

(57) ABSTRACT

Self-protection structure, comprising a first inner layer (2) made form a material having high resistant to the impact of a bullet (4), and at least a second outer pierceable layer (3) having a melting temperature relatively low so as to melt upon the arrival of the bullet (4) and to retain the latter by preventing the bounce thereof.

16 Claims, 9 Drawing Sheets

BULLET-PROOF STRUCTURE

The present invention refers to a bullet-proof structure, and namely a structure for self-protection, in particular for making bullet-proof clothes such as jackets, as well as shoes, helmets, spectacles and any outfit intended for personal protection.

STATE OF THE ART

Clothes are known, especially jackets, made up of a variable number of layers of anti-perforation material such as Kevlar (trade name) or aramidic fibres.

The traditional way of stopping bullets is that of capturing them by means of several layers of fabric.

When a bullet impinges on a layer of woven material, its tip encounters and passes thousands of fibres which break up, thereby allowing the explosion of the same bullet and causing an impact-induced trauma, of even high intensity, to the user.

Upon its passage through every layer of the fabric, the bullet binds the fibres and draws them along with it by continuously loosing energy until it comes eventually to a stop as it shatters and scatters within the same fabric.

In the impact, the energy of the bullet is only partially distributed by the garment, in order to avoid any excess of pressure on the body of the wearer, the same bullet however possibly reaching a depth of 40 mm inside the same garment. These known solutions exhibit the drawback that when the garment is reached by a bullet having a great energy, it occurs frequently that the same bullet is able to go through or anyway cause a localized impact, which is extremely harmful to the wearer.

This drawback is mainly due to the same operational principle which implies the risk that the bullet, by going through one or more layers of material, will deform upon the impact, thus causing the release of splinters of lead. The same deformability of the materials so far used implies also a local concentration of the stroke (impact-induced trauma) which may result itself harmful to the user.

Also known as bullet-proof structures are screens of strong materials, such as alumina or bullet-proof glass, which are used as shields for vehicles or facilities, houses, etc. These materials are generally capable of withstanding the impact of even very powerful bullets but, owing to their nature, do not absorb the energy, which is given back resiliently, thereby causing the divertion of the same bullet.

For this reason, the screens of such nature are not suited to make clothes. In fact, the bounce of bullets or their splinters is a serious and unacceptable risk in the presence of more operators.

SUMMARY OF THE INVENTION

A first object of the present invention is to overcome the drawbacks of the bullet-proof structure of known type for clothes.

The technical task and the specified objects are substantially obtained by a structure of material for clothes comprising the technical characteristics disclosed in one or more of the appended claims.

DETAILED DESCRIPTION

Further characteristics and advantages of the present invention will appear more clearly by the indicative and thus non-limiting description of a preferred embodiment of the invention as illustrated in the accompanying drawings, wherein.

Figure 1:
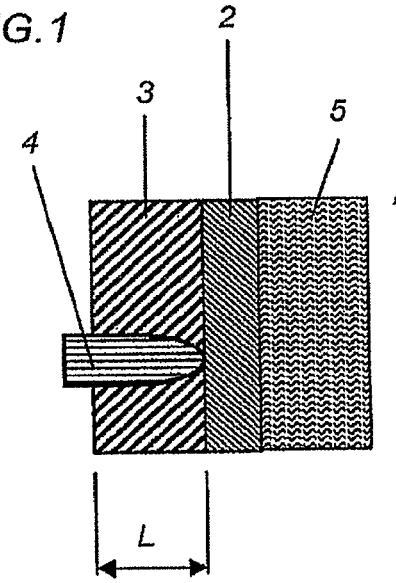
FIG. 1 is a schematic sectional view of the structure, according to the invention, being hit by a bullet.
Figure 2:
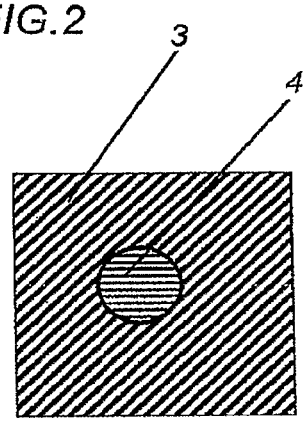
FIG. 2 shows the structure of FIG. 1 in a side view from the left.
Figure 3A:
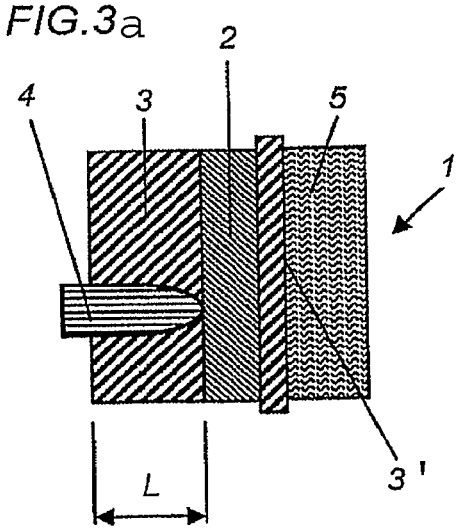
Figure 3B:
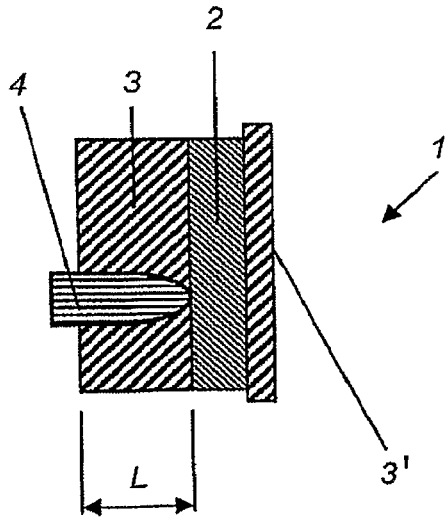
Figure 4:
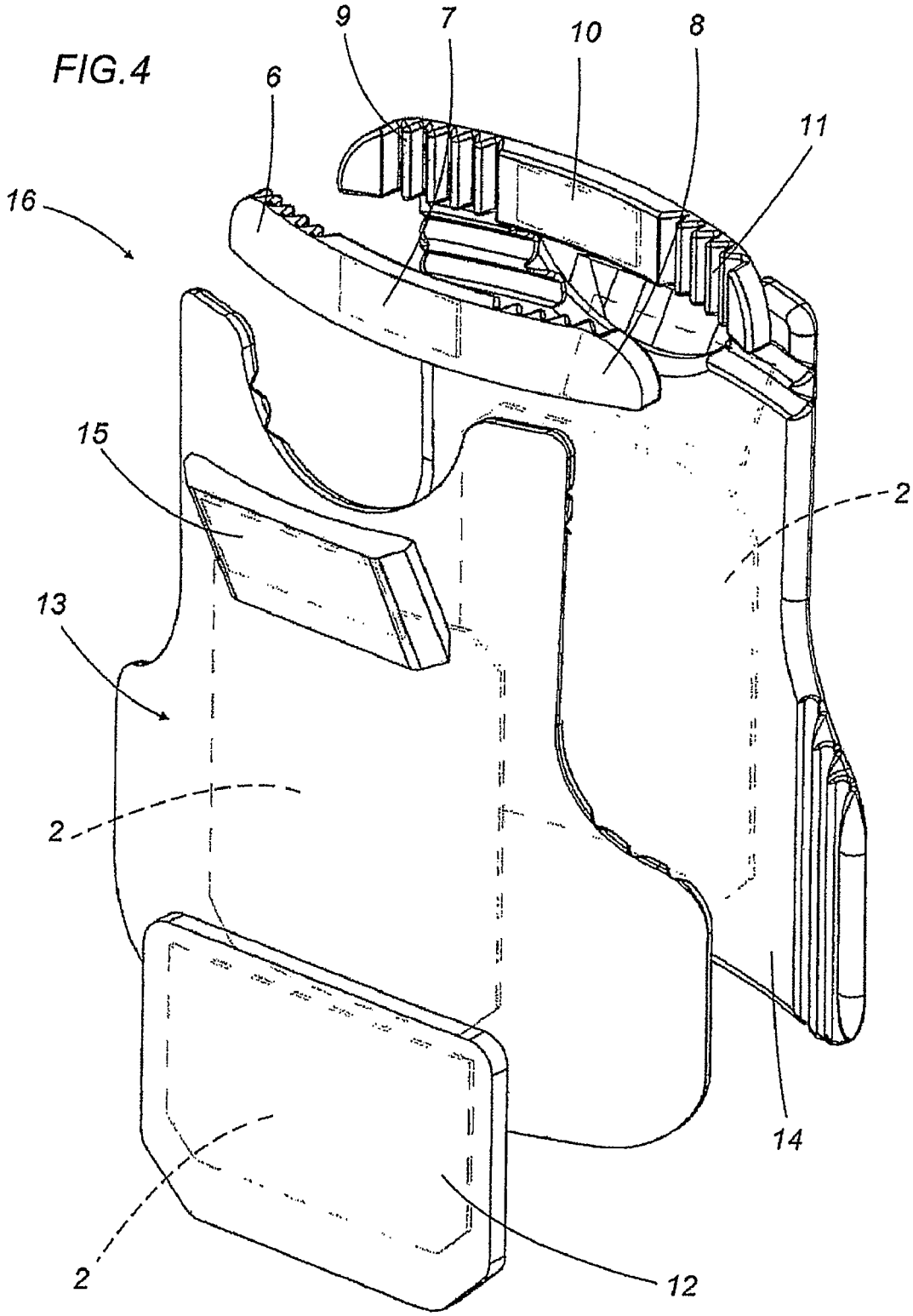
Figure 5:
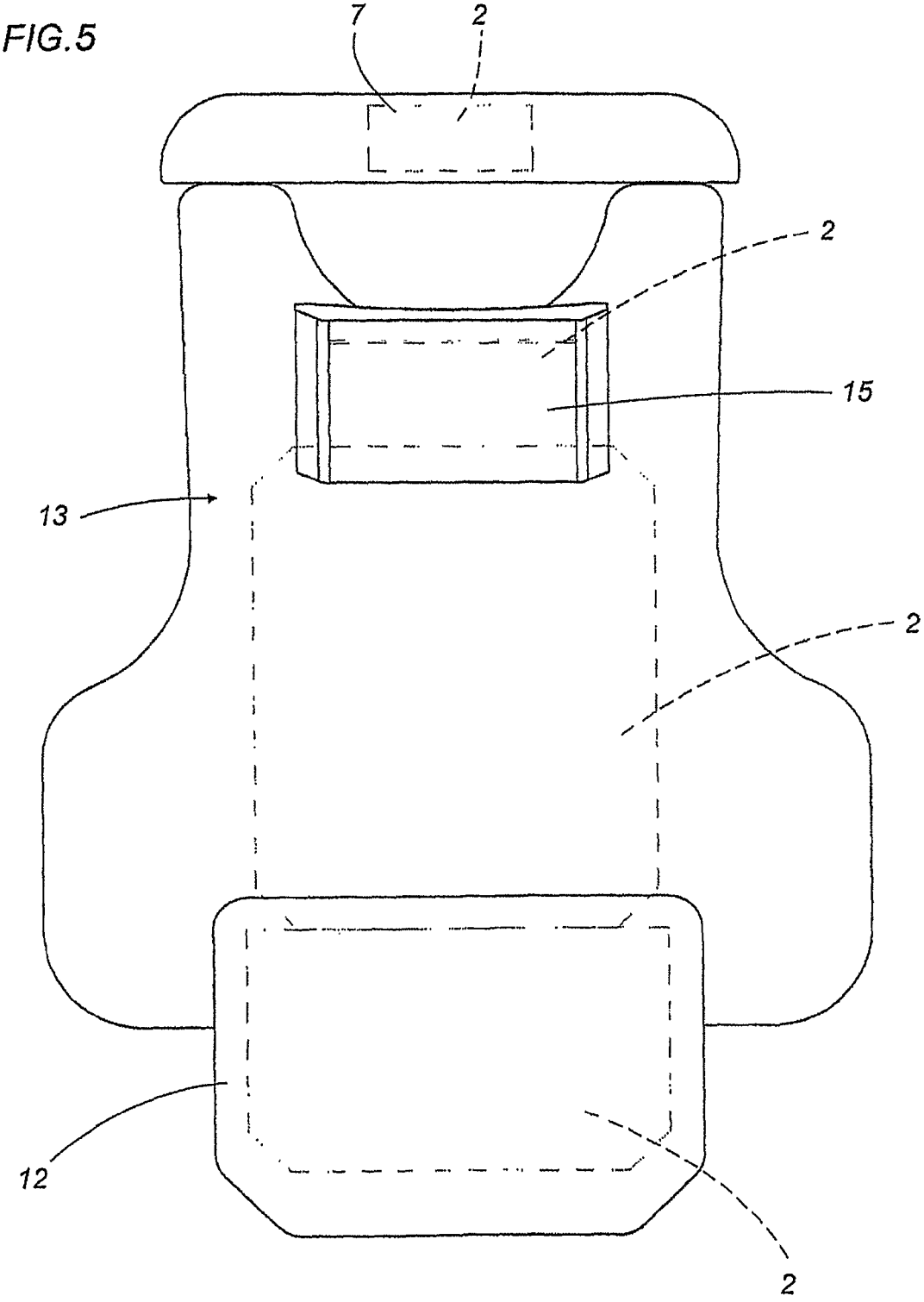
Figure 6:
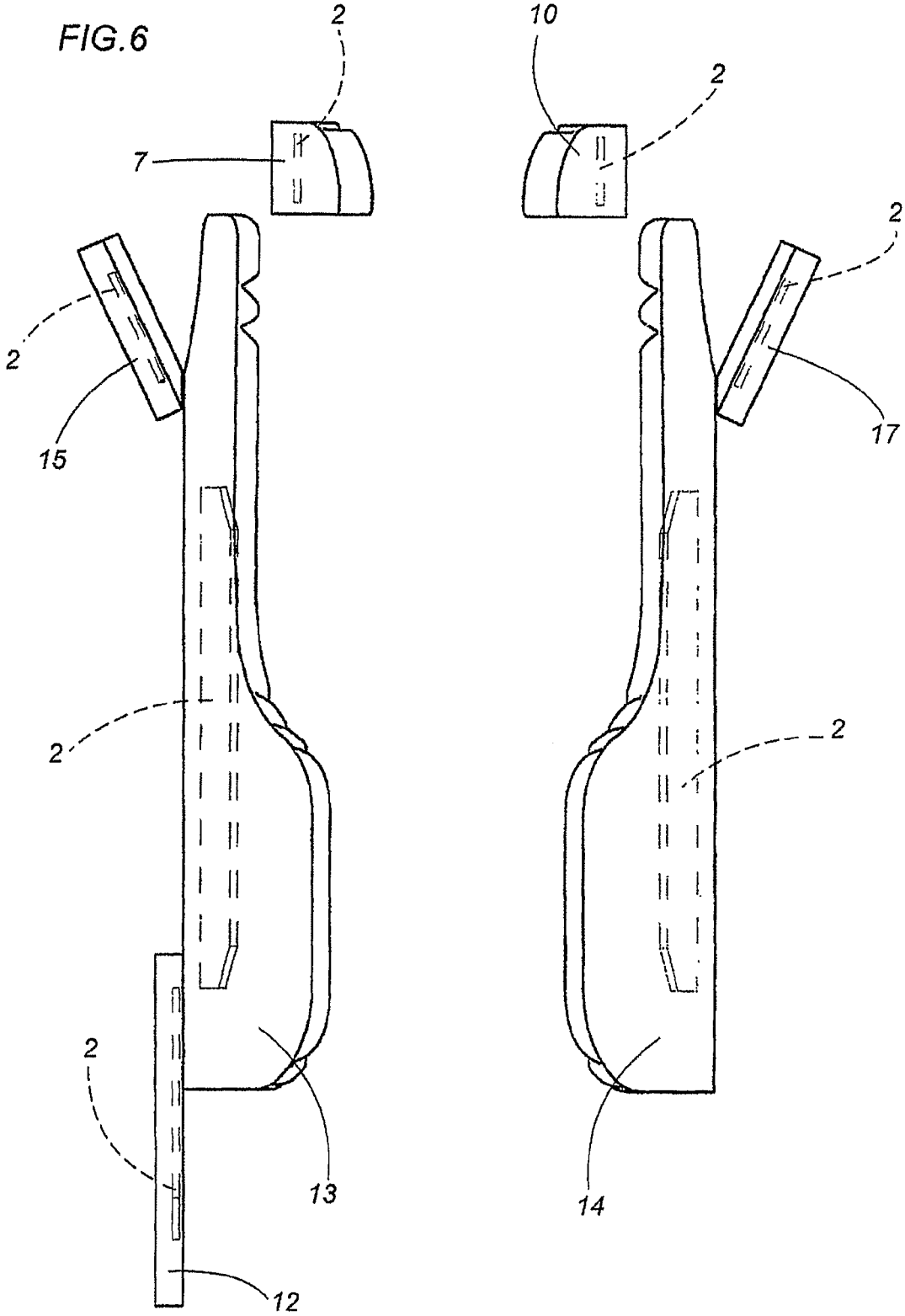
Figure 7:
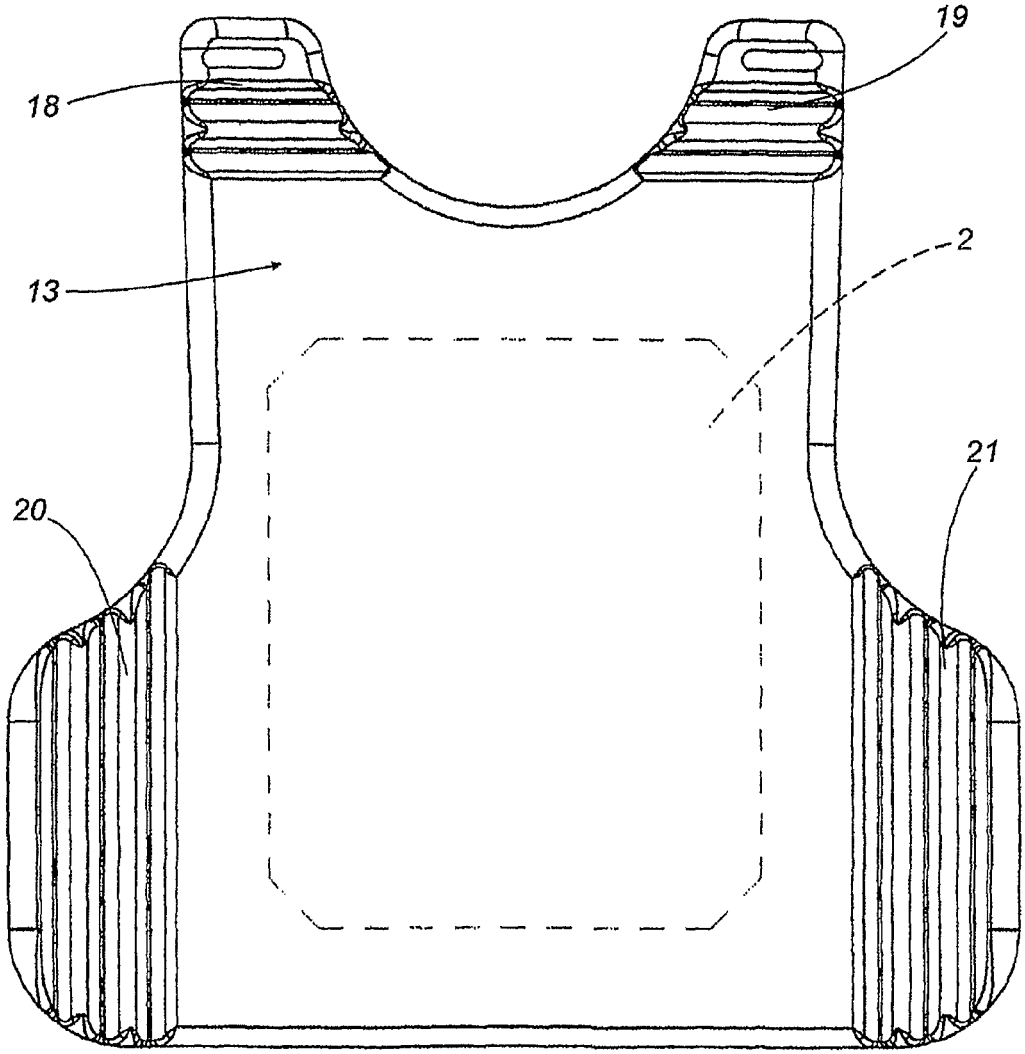
Figure 8:
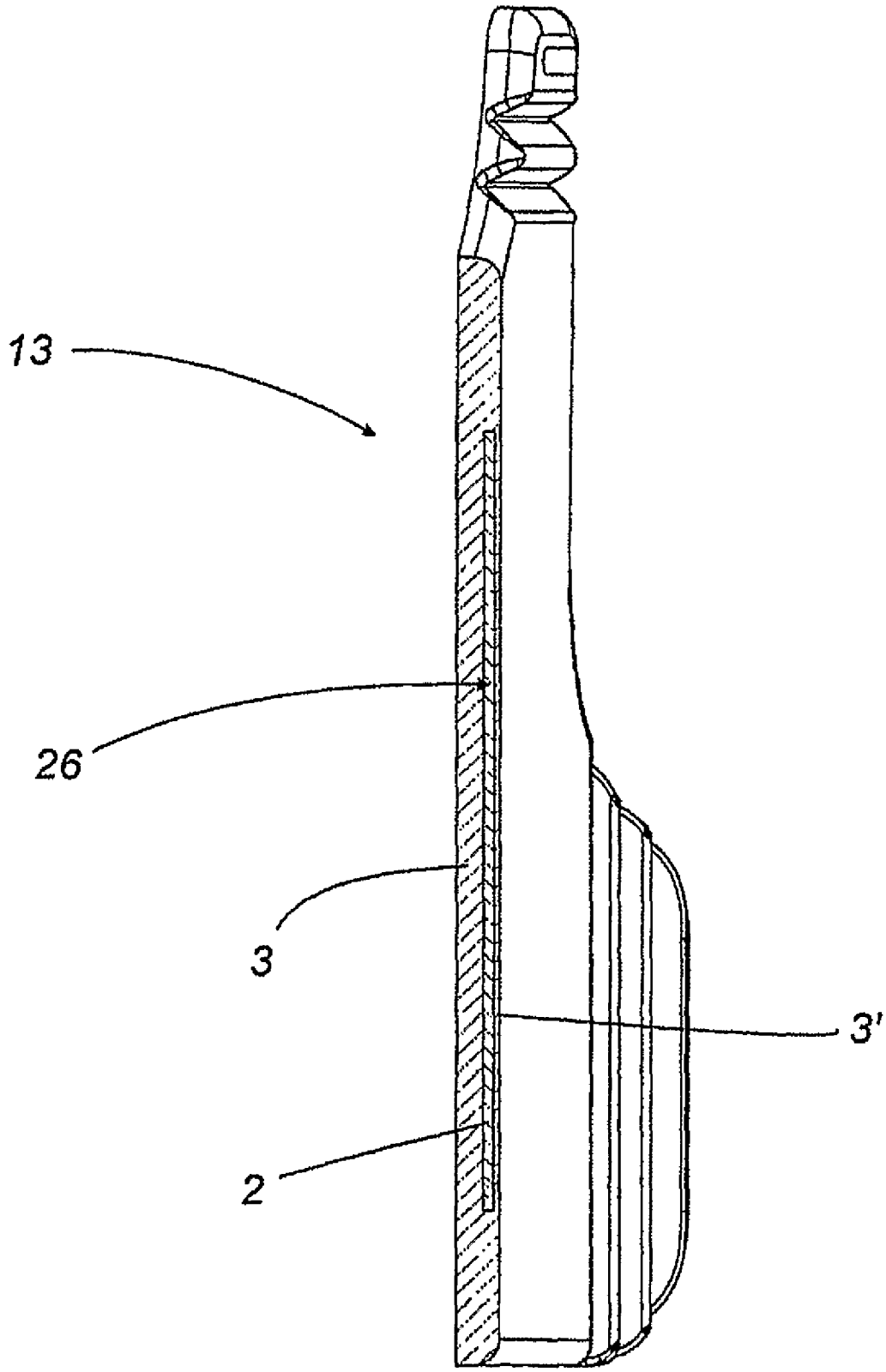
Figure 9:
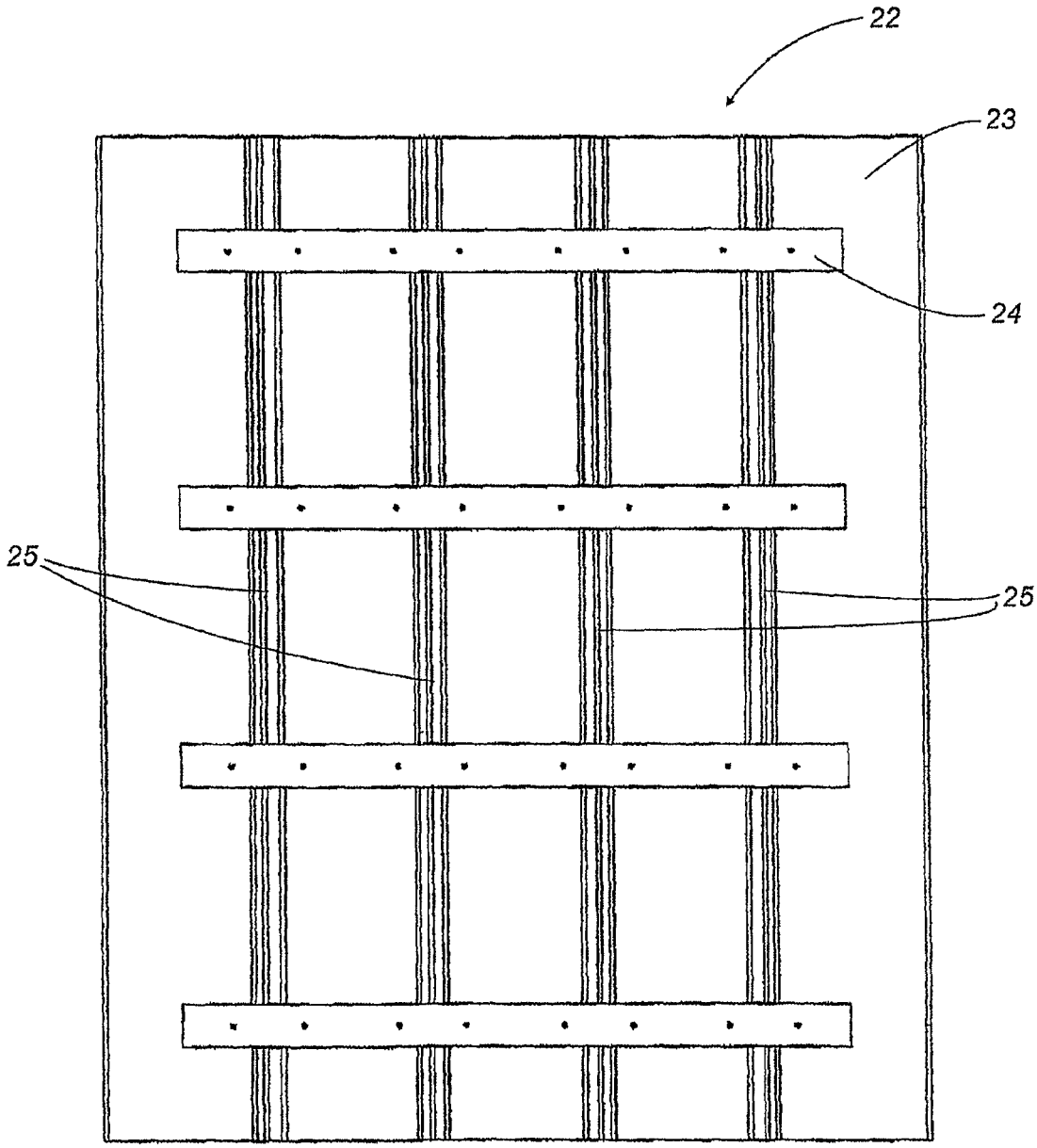
Figure 10:
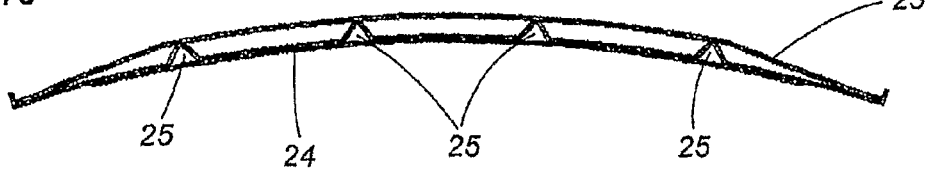
Figure 11:
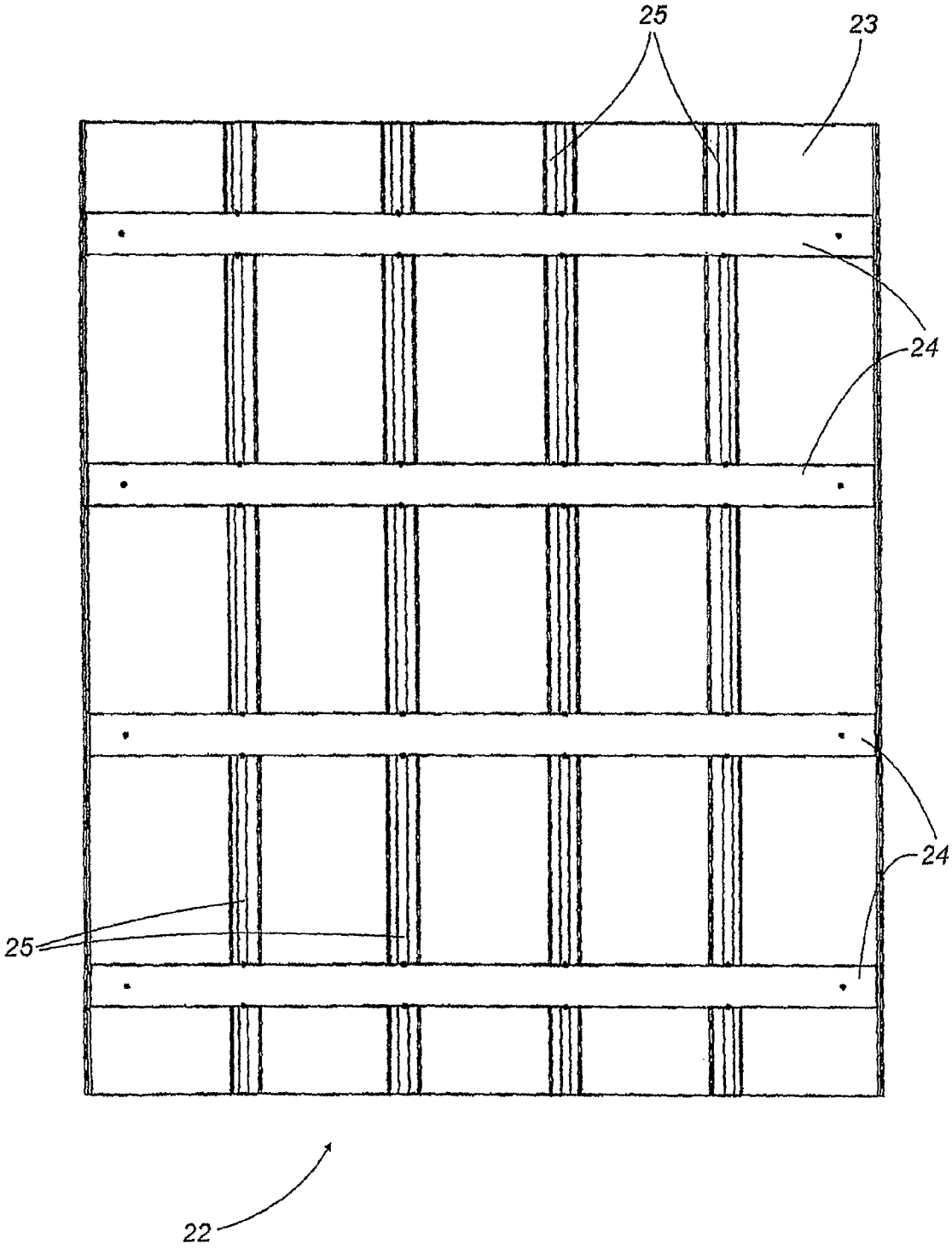
Figure 12:
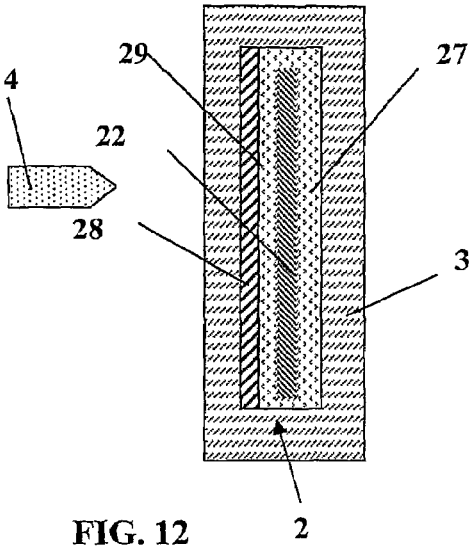
Figure 14:
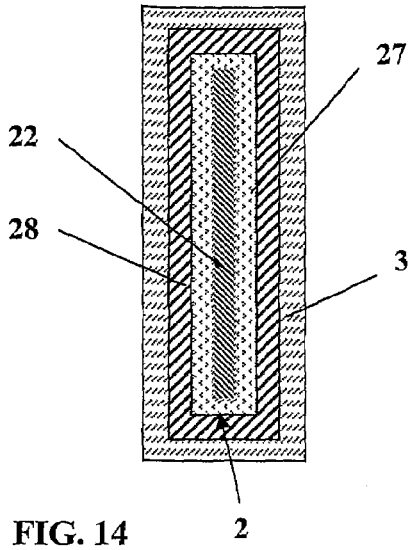
Figure 13:
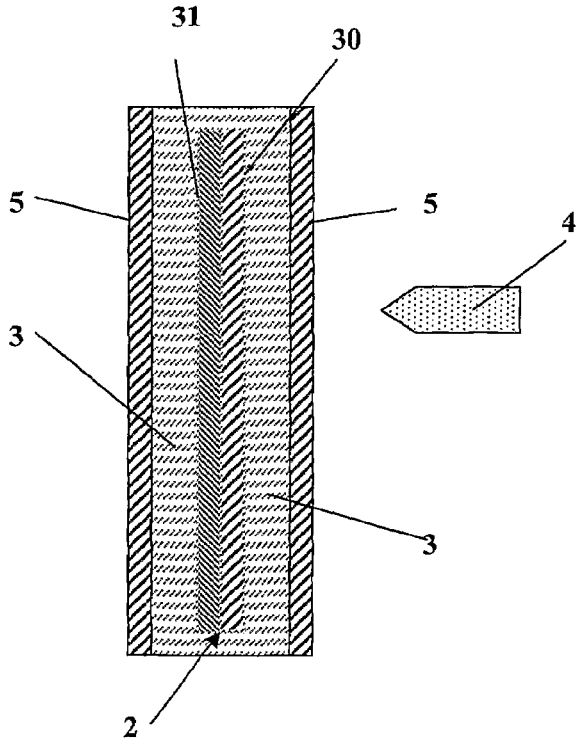

FIGS. 3*a*, 3*b* are schematic sectional view of a second and third embodiment of the structure according to the invention;

FIG. 4 is an exploded view of the protective components of a bullet-proof jacket according to the present invention;

FIG. 5 is a front view of the jacket of FIG. 4;

FIG. 6 is a side view of the jacket of FIG. 4;

FIG. 7 shows the inner portion of the bust-shield of the jacket shown in FIG. 4;

FIG. 8 is a sectional side view of the bust-shield shown in FIG. 4;

FIG. 9 is a front view of the inner portion of an unpierceable sheet according to the invention;

FIG. 10 is a cross-section of the sheet of FIG. 9;

FIG. 11 is a front view of the outer portion of the sheet shown in FIG. 9;

FIG. 12 shows an embodiment of the structure according to the invention;

FIG. 13 shows a further embodiment of the structure according to the invention, and FIG. 14 shows a further embodiment of the structure according to the invention.

With reference to the accompanying figures, a structure 1 of a bullet-proof garment for self-protection according to the invention comprises a layer 2 of highly resistant material, preferably of a material selected from alumina, bullet-proof glass and boron carbide, ceramic material, polyamide, aramidic fibre.

The layer 2 is intended to form the garment's inner unpierceable layer, also called ballistic panel, and is externally coated with a layer 3 of pierceable material having a relatively low melting point, for example, in the range of 200-300° C.

Preferably, the layer 3 is of a material selected from polyamide, polyurethane, polypropylene, polyvinyl chloride (PVC) and derivatives of such materials.

For instance, the layer 3 may be made in polyamide 6 or 66 (or their derivatives) possibly filled with 10-77% of glass fibres, or with fibres of steel, titanium, or carbon fibres in suitable percentages. Advantageously, according to the invention, upon the impact of a bullet 4 onto the structure, the pierceable outer layer 3 is reached first by the bullet and it melts because of the bullet's high temperature, the latter varying according to the type of bullet but exceeding in general the 300° C. and, anyway, being above the melting point of the bullet's material.

The layer 3, by melting upon the arrival of the bullet stopped against the unpierceable layer 2, catches the same bullet and retains it by preventing the bounce thereof.

The thickness of the layer 3 can possibly vary from point to point of the structure and is roughly in the range of 5 to 50 mm, so as to be able to enclose a bullet length L sufficient to prevent the divertion thereof.

The structure 1 may also comprise a further inner layer 5, made of elastomeric material and intended to improve the weareability of the garment and to distribute over the whole surface of the structure the pressure (trauma) produced by the impact of the bullet against the layer 2 and transmitted to the whole structure by the rigidity of the material forming the same layer 2.

It will be appreciated that also the first layer 2 may have a different mean thickness, depending on the application which the structure is intended for, and anyway ranging roughly between 3 and 10 mm.

According to the invention, the above described structure can be used for making different types of clothes, for example, protective jackets and other clothes, as well as helmets, shoes and goggles for self-protection in general. Depending on the application, the shape of layer 2 will possibly vary to take up an ergonomic configuration, for example.

Moreover, the layer 2 will possibly be formed into a rigid composition of more portions.

In a preferred embodiment, a garment according to the invention is obtained by an injection moulding process with a mould of steel inside which a template, making up said first unpierceable layer, is fixed at preset distances from the mould's walls.

By disposing suitable spacers, the template forms gaps of different spacings in one or both its surfaces, into which the material forming said second layer can be injected. The result will be a screen with a central layer 2 and two layers 3, 3', one being internal and the other external. Finally, the garment will possibly be coated with further layers 5 intended for absorbing the kinetic energy of the bullet and providing an external envelope of woven material, for example a mimetic fabric of known type. Referring now to FIGS. 4 to 8, a bullet-proof jacket 16 made according to the present invention is described.

The above jacket 16 comprises in its main parts:

two front and rear neck-shield protective elements 7, 10;

two front and rear underneck protective elements 15, 17;

two front and rear bust-shield protective elements 13, 14; and one groin-shield protective element 12.

The protective bust- and neck-shield elements comprise also respective deformable ends 6/8, 9/11, 18/19/20/21, which are partially movable to accommodate the size of the wearer's body.

In FIG. 7, which shows the inner part of the bust-shield 13, the above cited deformable ends can be observed. In particular, four ends 18/19/20/21 are provided in the bust-shield 13, the ends 18 and 19 being able to accommodate the shape of the bust-shield 13 to the shape of the upper part of the user's bust, while the two ends 210 and 21 are able to accommodate the bust-shield 13 to the shape of the user's pelvis.

FIG. 8 shows, in sectional view, how the unpierceable layer 2 is incorporated in the pierceable thermoplastic material 3 and is disposed between two layers 3/3' thereof which are obtained by providing within the mould suitable gaps to be filled with thermoplastic material upon the injection process.

With reference to FIGS. 9, 10 and 11, a preferred solution is described of the unpierceable layer 2.

Preferably, in this exemplary embodiment, the layer 2 consists of a sheet 26 obtained by injection-moulding a mixture of aramidic fibres in a metallic armor 22, preferably made of steel but not being limited thereto. Preferably, the steel used will be of high resistance or a steel for music wire, and subjected to special treatment to improve its hardness.

More in detail, the above cited metal armor 22 comprises a sheet 23 shaped with a series of parallel ribs obtained by moulding the same sheet and having thereabove cross-pieces 24 fixed (for example, by welding) in correspondence of the ribs and of side edges of the sheet in order to reinforce the armor 22.

The cross-pieces 24 and ribs 25 are, moreover, the elements which, upon the injection of the aramidic fibres, form the containment "supports" for the uniform distribution of the same fibres inside the mould.

Advantageously, the sheet 26 makes it possible to shape the unpierceable layer 2 at will and to obtain therefore a better degree of protection of the wearer's body.

In a further preferred embodiment, the armor 22 may also comprise a metal net being welded in place of the cross-pieces 24.

Shown schematically in FIG. 12 is the resistant layer 2 of a structure according to the invention, said layer being composed of a steel sheet 226 incorporated in a die-cast aluminum shell 27 which is in turn incorporated in the shell made of anti-bounce material 3.

In a further embodiment shown by FIG. 12, the aluminum shell 27 can possibly be matched with a layer 28 of thermoplastic material, at least on the outer face 29 of the die-cast aluminium shell 27 (that is, the side of the incoming bullet 4), by further injection-moulding the material together with the shell 3. Preferably, layer 28 contains additives increasing the density of the layer, in order to dissipate heat and to absorb energy from the incoming bullet.

The solution above described has the advantage of improving the adhesion between the layer 28 and the metal body 26/27 and, therefore, of counteracting with greater efficacy the detachment of the two layers.

It is stressed that the resistance to the detachment between the metal sheet and the resistant thermoplastic material (which includes, for example, aramidic fibres) entails a higher resistance to the deformation of the sheet and a better containment of the bullet impact.

In FIG. 14 an embodiment of the invention is shown, in which the layer 28 completely surrounds the aluminium shell 27.

Schematically shown in FIG. 13 is a preferred solution of the inventive structure, wherein the resistant layer 2 comprises a first resistant layer 31 which includes a material preferably selected from glass, alumina, ceramics, steel, special steels.

At least on the outer side of arrival of bullet 4, the layer 31 is matched with a second resistant, thermoplastic layer 30 which comprises a material selected from polyamides, polyurethane, polypropylene, polyvinyl chloride and derivatives thereof, which material is filled with resistant fibres, either short or long, selected from aramidic, ceramic, carbon, titanium, and glass fibres. Advantageously, in this solution, the anti-bounce layer 3 comprises in turn a thermoplastic material of the same category selected for the formation of the second resistant material 30, in order to increase the mutual adhesion between the resistant layer 2 and the anti-bounce layer 3, which melt together, and preventing the detachment of the interface thereof and, thus, improving the integrity of the structure upon the arrival of bullets 4.

Finally, outside the anti-bounce material a further layer 5 of anti-impact material such as latex, for example, may be provided.

It has been found, besides, that to improve the performance of the materials used for the die-casting process, whether they are thermoplastic material, or fibres or aluminum, it is advantageous to add an inert material, such as talc powder, to the same materials.

By this solution the tendency to shrinkage of the die-cast material is reduced and a better dimensional stability of the structure is obtained.

The advantages derived from the invention lie in the fact that a thus conceived structure ensures a high unpierceability and, at the same time, a distribution of the impact over a large surface, with a corresponding reduction of the specific pressure on the garment wearer's body and almost absence of impact-induced trauma.

A further advantage is due to the ability of the structure to absorb the bullets which are made ductile by the high temperature, the same bullets remaining "drowned" in the thickness of the material of the outer layer after their impact with the unpierceable layer, instead of breaking up and bouncing off. This, in particular, taking place with angles of impact other than 90°.

Moreover, a garment made with a structure thus conceived is not subject to deterioration until the impact of the bullet, is considerably lighter—the efficacy and protected surface being equal—than the materials for self-protection presently used, and is apt to be constructed for interchangeability of the various parts which the garment is made of.

The invention thus devised may also be subjected to several modifications and variants without departing from the scope of the inventive principle; moreover, all the parts may be replaced by technically equivalent elements.

By way of example, the structure of the invention is suited for applications of different type, including the armor-plating of doors, vehicles, aeroplanes, and protective panellings in general.

The invention claimed is:

1. A bullet-proof structure comprising a first layer (2), a second layer (3), and a third layer (3'), the first layer being located between the second and third layers, each of the second and third layers being coated on the first layer, the first layer being effectively resistant to penetration of a fired bullet, the first layer comprising a material selected from the group consisting of alumina, bullet-proof glass, boron carbide, aramidic fiber, ceramics, steel, and mixtures of these materials, the second layer being a thermoplastic material having a melting point between 200 and 300° C., the second layer having a mean thickness in the range of 5 to 50 mm, the third layer being a thermoplastic material having a melting point between 200 and 300° C., wherein the first layer (2) comprises a first resistant layer (31) which, at least on the side of an incoming bullet (4), is matched with a second resistant layer (30) comprising a material selected from polyamides, polyurethane, polypropylene, polyvinyl chloride and derivatives of these materials, and said second layer (3) comprises a thermoplastic material of the same category as the second resistant layer (30) in order to improve the mutual adhesion between the first layer (2) and the second layer (3).

2. Structure according to claim 1, wherein the second and third layers define a screen-shell of thermoplastic material which incorporates the first layer.

3. Structure according to claim 1, comprising a further layer (5) made of elastomeric material, the third layer being located between the first layer and the further layer (5).

4. Structure according to claim 1, wherein the second layer thermoplastic material comprises a material selected from the group consisting of polyamides, polyurethane, polypropylene, polyvinyl chloride and derivatives of these materials.

5. Structure according to claim 4, wherein said second layer thermoplastic material is filled with 10-77% of glass fibers, or with fibers of steel, titanium, or carbon.

6. Structure according to claim 1, wherein said first layer (2) has a mean thickness between 3 and 10 mm.

7. Structure according to claim 1, wherein said first layer (2) is obtained by injection-moulding a mixture of thermoplastic material along with a metal armor (22).

8. Structure according to claim 7, wherein the armor (22) comprises a sheet (23) shaped in the form of parallel ribs (25) having cross-pieces (24) thereabove to reinforce the armor (22) and improve the adhesion of the sheet.

9. Structure according to claim 7, wherein the armor (22) comprises a metal net welded at least to the outer face of a wall to reinforce the armor (22) and improve the adhesion of the sheet.

10. Structure according to claim 7, wherein said first layer (2) is made of a steel sheet (26) incorporated in a die-cast aluminum shell (27).

11. Structure according to claim 10, wherein said first layer (2) comprises a layer (28) of thermoplastic material being joined at least to an outer face (29) of the die-cast aluminium shell by further injection-moulding the material with the shell.

12. Bullet-proof garment comprising at least one element of the bullet-proof structure (1) according to claim 1.

13. Garment according to claim 12, wherein said element is formed by an injection moulding process within a mould having fixed therein, at preset distances from the walls of said mould, a rigid template making up said first layer (2), so as to form gaps into which the material making up the second layer (3) has been injected.

14. Garment according to claim 12, comprising an outer envelope for the containment of the elements forming the garment.

15. Garment according to claim 12, comprising:

two front and rear neck-shield protective elements (7, 10);

two front and rear underneck protective elements (15, 17);

two front and rear bust-shield protective elements (13, 14); and one groin-shield protective element (12).

16. Garment according to claim 15, wherein at least one of said elements is removable and replaceable.

* * * * *